United States Patent [19]

Tsuei

[11] 4,194,252

[45] Mar. 25, 1980

[54] BISTABLE TRIP OVERFLOW LEVER

[75] Inventor: Chang-Ling Tsuei, Los Angeles, Calif.

[73] Assignee: Price-Pfister Brass Mfg. Co., Pacoima, Calif.

[21] Appl. No.: 933,486

[22] Filed: Aug. 14, 1978

[51] Int. Cl.[2] ..... E03C 1/24

[52] U.S. Cl. ..... 4/199; 4/206; 74/97; 74/520

[58] Field of Search ..... 4/199, 200, 201, 203, 4/204, 206, 198; 74/97, 100 R, 520; 267/160, 164

[56] References Cited

U.S. PATENT DOCUMENTS

| | | | |
|---|---|---|---|
| 1,028,327 | 6/1912 | Carter | 4/199 |
| 4,085,469 | 4/1978 | Petursson | 4/199 |
| 4,089,230 | 5/1978 | Nelson | 4/199 |

*Primary Examiner*—Frederick R. Schmidt
*Attorney, Agent, or Firm*—Flam & Flam

[57] ABSTRACT

An escutcheon plate for the bath overflow fitting conventionally mounts a trip lever for operating the bath drain plug. The center of the lever is pivoted on the escutcheon plate to provide an outer handle end and an inner crank end. The outer handle end is tilted up or down to open or close the drain plug. A spring arrangement stabilizes the lever in both positions, the central position being unstable. A simple wire spring is attached at opposite ends to the lever and a fulcrum located inwardly of the pivot axis of the lever. The spring acts as a toggle, being compressed to a maximum when its points of attachment are in line with the lever pivot axis. A bistable arrangement is provided in the simplest possible manner.

4 Claims, 5 Drawing Figures

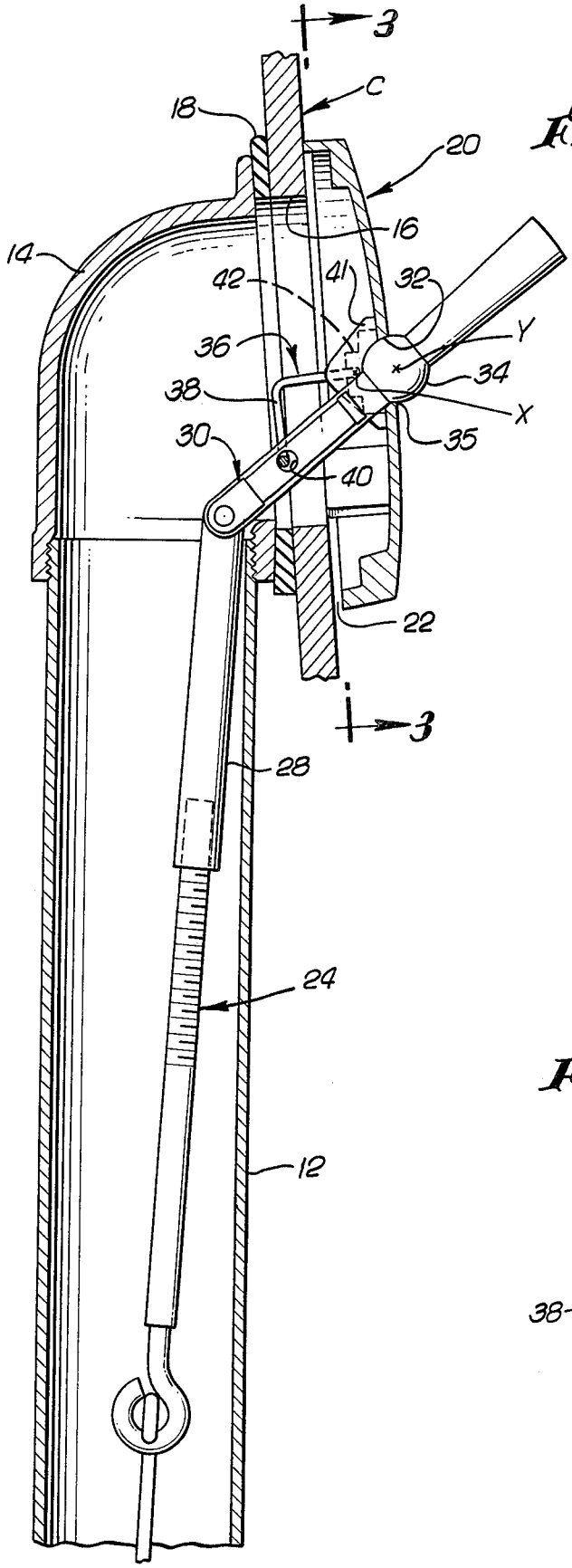
FIG. 2.
FIG. 4.
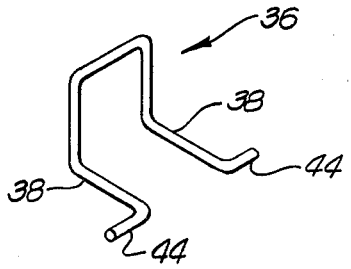

BISTABLE TRIP OVERFLOW LEVER

FIELD OF INVENTION

The present invention relates to plumbing fixtures, and more particularly to a bistable lever mounted at a bathtub overflow for operating the bathtub drain stopper.

BACKGROUND OF THE INVENTION

Description of the Prior Art

A bathtub drain stopper can, of course, be designed in such a manner that it is closed and opened by reaching into the tub and moving it. This is often considered objectionable. Consequently, it has been common to provide linkages that extend through the drain fitting and the overflow fitting, the operating lever or crank being mounted on an escutcheon plate that conceals, but does not block the opening to the overflow fitting.

Mechanisms of this type desirably include weights or springs to hold the operating lever and the associated mechanism in a stable manner either in open or closed position so that unwanted opening or closing is avoided. It has been common to provide an arrangement in which a pair of washers are mounted on the inner end of the lever with a coil spring in between and surrounding the lever. A cross pin on the lever holds the outer washer against separation from the lever. The inner washer rides on a cam formed on the inside of the escutcheon plate. The cam determines alternate stable positions, the cam having a central lobe that compresses the spring to a maximum. An improvement upon this arrangement is shown in U.S. Pat. No. 3,551,921 to W. R. Fox et al. in which a U-shaped spring takes the place of three separate pieces, namely the two washers and the coil spring. A cross pin is still required. In either arrangement, sliding friction on the cam lobes still must be overcome. The action may be rough.

OBJECTIVES

The primary object of the present invention is to provide a mechanism for determining bistable orientation of a trip lever in a waste overflow in which the number of operating parts in addition to the lever is reduced to one, so that not even a cross pin is required in the lever and so that there is no longer any frictional drag of any cam structure.

SUMMARY OF INVENTION

In order to accomplish the foregoing objects, I provide a wire spring of generally U-shaped configuration. The central portion of the spring extends through a hole in the lever and its ends are anchored at the inside of the escutcheon plate on opposite sides of the lever. When the lever hole moves into line with the pivot axis of the lever and the anchor axis of the spring, the spring is compressed to a maximum. As soon as the lever shifts from this position, the lever snaps to one of two stable positions. Anchor slots for the spring are readily cast in blocks formed on the inside of the escutcheon plate. The hole in the lever is the same hole that in prior art devices mounts a cross pin to stop washer movement and to maintain spring compression.

BRIEF DESCRIPTION OF THE DRAWINGS

A detailed description of the invention will be made with reference to the accompanying drawings wherein like numerals designate corresponding parts in the several figures. These drawings are to scale.

FIG. 2 is an enlarged vertical sectional view showing the bistable trip lever mechanisms incorporating the present invention.

FIG. 4 is a pictorial view of the toggle spring.

DETAILED DESCRIPTION OF THE PREFERRED EMBODIMENT

Figure 1:
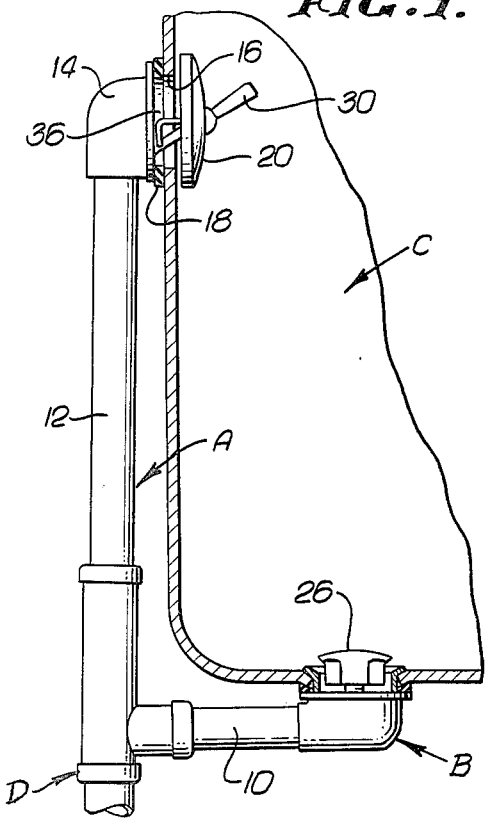
FIG. 1 is a vertical sectional view of a drain and overflow fitting for a bathtub, part of the bathtub being shown in section.

The following detailed description is of the best presently contemplated mode of carrying out of the invention. This description is not to be taken in a limiting sense, but is made merely for purposes of illustrating the general principles of the invention since the scope of the invention is best defined by the appended claims.

A composite bathtub drain fitting A cooperates with a drain elbow B either to conduct waste water from a bathtub C via a horizontal drain tube 10 or to conduct overflow water via a vertical drain tube 12. An overflow elbow 14 on top of the overflow tube 12 is fitted to the overflow opening 16 (FIG. 2) of the bathtub C. The elbow carries a gasket 18. A circular escutcheon plate 20 overlies the tub opening 16. Screws 21 (FIG. 3) pass through the escutcheon plate 20 and engage the overflow elbow 14. The gasket 18 is thereby compressed to provide a seal. The escutcheon plate is provided with the usual openings 22 around the outside diameter for overflow water.

Figure 5:
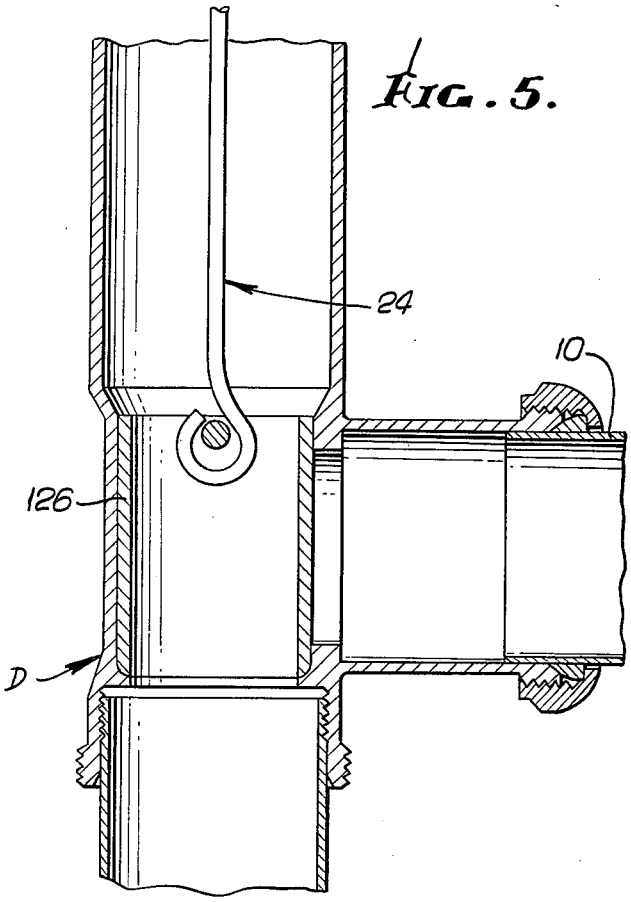
FIG. 5 is an enlarged fragmentary sectional view showing a hollow bucket or drop valve to hold water in the tub or to release it.

Accommodated in the drain tube and the overflow tube is a linkage 24 for raising and lowering the bathtub drain stopper 26. Instead of operating a stopper, the linkage can be used to raise and lower a hollow bucket or drop valve 126 (FIG. 5) located at the drain tee D. The linkage includes a part 28 that projects into the overflow elbow 14 for actuation by the inner end of a trip lever 30. The lever 30 projects through a central opening 32 in the plate 20. A pin connection between the linkage part 28 and the inner end of the lever 30 is provided. When the linkage part is lifted, the drain stopper 26 is seated; and when the linkage part 28 is lowered, as in FIG. 2, the stopper 26 is lifted. If, instead, a bucket or drop valve is used (FIG. 5), the valve opens when the part 28 is lifted, and closes when the part 28 is lowered.

The lever 30 is provided with the usual ball fulcrum 34 that engages the outer edges 35 of the plate opening 32 for pivotal mounting of the lever.

In order to determine alternate stable positions of the linkage part 28 and the lever, a toggle spring 36 is provided. The toggle spring (FIG. 4) is generally U-shaped, with its arms 38 correspondingly angled to provide a compression spring action as the angle reduces or closes, all in the manner hereinafter to be described.

Figure 3:
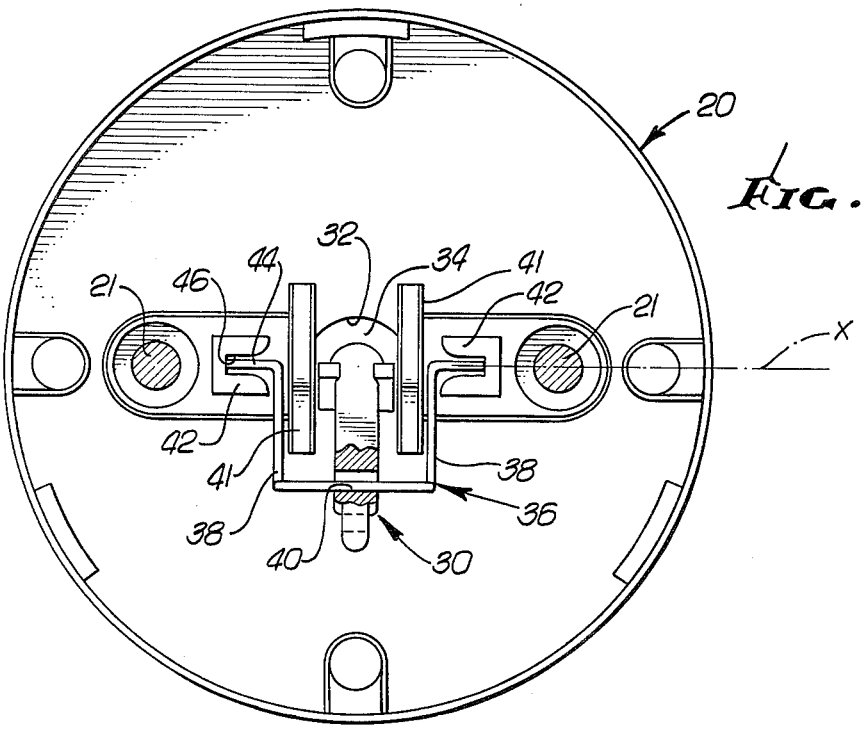
FIG. 3 is a sectional view taken along the plane indicated by line 3—3 of FIG. 2, and showing the inside of the escutcheon plate in elevation.

The toggle spring 36 extends through a transverse hole 40 in the lever 30 (see also FIG. 3) so that the central portion of the toggle spring is anchored. The arms 38 extend back towards the escutcheon plate respectively along the outer sides of a pair of lever guides 41 to a pair of pivot or mounting blocks 42. The pivot blocks 42 are located on the inside of the plate on opposite sides of the opening 32. The distal ends 44 of the toggle spring arms 38 are outwardly bent in order to seat in mounting slots 46 of the pivot blocks 42. The slots 46 provide bearing recesses for the spring ends 44. Spring tension keeps the ends 44 seated while the configuration of the slots stops the ends 44 from moving up, down or laterally. The ends 44 freely pivot about a common axis x of the bearing recesses of slots 46 (FIGS. 2 and 3). The axis x is spaced from the axis y of the lever fulcrum 34. The slots are accessible for snap insertion of the ends 44 when the lever 30 is tilted up or down.

The spring 36 undergoes compression and expansion as the lever shifts. Maximum compression occurs when the mounting hole 40 in the lever is horizontally in line with the lever fulcrum axis y and the pivot axis x. This occurs when the lever is in its central position. The central position is accordingly unstable. The lever tends to snap alternately to its up or down position. In both such positions, one of which being shown in FIG. 2, the toggle spring 36 is yet slightly stressed so that a positive lever holding force is provided. The toggle spring at all times exerts a force urging the trip lever fulcrum ball 34 to seat. The limits to movement of the lever are determined ordinarily by the stopper, bucket or other parts of the linkage mechanism.

The guides 41 prevent the lever from rotation by engagement with flat sides of the lever should excess angular movement take place. The spring 36 clears the sides of the guides. The toggle spring does not slide on any cam or other mechanism. Consequently, the action of the lever is smooth and agreeable to the touch. Positive bistable operation is achieved by one simple part, namely, a spring. The mounting blocks 42 and slots 46 are easily cast in the back of the escutcheon plate 20.

Intending to claim all novel, useful and unobvious features shown or described, I make the following claims:

1. In a bistable drain plug trip lever mechanism:

(a) a mounting plate having a hole providing access between its outer side and its inner side;

(b) a trip lever projecting through the hole in the mounting plate, said lever having an outer handle end and an inner operating end; said operating end having a transverse opening;

(c) said mounting plate and said lever having fulcrum means mounting said lever for angular movement, said fulcrum means defining a fulcrum axis;

(d) means determining opposite limits to tilting movement of said lever;

(e) means located on the inside of said mounting plate providing a bearing recess, said bearing recess defining a pivot axis spaced from, but substantially parallel to said fulcrum axis;

(f) a compression spring having one part projected through said opening of said operating end of the lever to anchor said spring on said operating end, said spring having another part accommodated in said bearing recess; and (g) said spring being compressed to maximum when said lever is tilted to an intermediate position in which said hole, pivot axis and fulcrum axis are aligned whereby said lever is bistable between said opposite limits.

2. The mechanism as set forth in claim 1 in which said fulcrum means comprising a ball provided on the lever and a companion ball seat extending about said hole of the plate; said compression spring maintaining said fulcrum means seated.

3. The mechanism as set forth in claim 1 in which said spring is generally U-shaped to provide a central anchor portion and having substantially parallel arms correspondingly bent to provide compression spring action upon reduction or closure in the angle of the arms, said spring arms having distal ends aligned with each other and respectively anchored in said bearing recess.

4. In a bistable drain plug trip lever mechanism:

(a) an escutcheon plate adapted to overlie the overflow opening of a tub;

(b) said plate having an opening surrounded on the outside by a seat;

(c) a trip lever projecting through said opening and having a fulcrum member engaging said seat, said lever having a transverse anchor opening on its inner end;

(d) said escutcheon plate having a pair of mounting blocks located on the inside of the plate and on opposite sides of said plate opening, said blocks having aligned openings extending substantially transverse to the axis of the plate opening;

(e) a wire spring having a generally U-shaped configuration with arms correspondingly bent to provide an angled configuration, said wire spring extending through said anchor opening of said lever with the arms extending back along opposite sides of the lever, the distal ends of said spring arms having transversely bent ends accommodated respectively in the aligned openings of said blocks;

(f) said spring being compressed to a maximum when said lever opening is aligned with said block openings and said plate opening thereby determining alternate stable positions of said lever by overcenter operation of said spring; and (g) said spring contacting only said mounting block and the anchor opening of said lever.

* * * * *